US007380374B1

(12) United States Patent
Pratt

(10) Patent No.: US 7,380,374 B1
(45) Date of Patent: Jun. 3, 2008

(54) CURTAIN DRAIN

(76) Inventor: James M. Pratt, P.O. Box 920624, Needham, MA (US) 02492

( * ) Notice: Subject to any disclaimer, the term of this patent is extended or adjusted under 35 U.S.C. 154(b) by 163 days.

(21) Appl. No.: 11/397,385

(22) Filed: Apr. 5, 2006

(51) Int. Cl.
*E02D 19/00* (2006.01)

(52) U.S. Cl. ..... 52/169.5; 52/302.1; 52/741.13; 405/43; 405/44; 405/45; 405/50

(58) Field of Classification Search ..... 52/741.13, 52/169.1–169.9, 169.13, 302.1–302.7; 405/43–45, 405/50
See application file for complete search history.

(56) References Cited

U.S. PATENT DOCUMENTS 4,745,716 A * 5/1988 Kuypers ..... 52/169.5
5,501,044 A * 3/1996 Janesky ..... 52/169.5
6,238,766 B1 * 5/2001 Massett et al. ..... 428/99
6,739,800 B2 * 5/2004 Bevilacqua ..... 405/48
6,786,011 B2 * 9/2004 Mares ..... 52/62
6,904,723 B1 * 6/2005 Moore et al. ..... 52/169.5
2002/0139068 A1 * 10/2002 Janesky ..... 52/169.5
2005/0198916 A1 * 9/2005 Janesky ..... 52/169.5
2007/0022677 A1 * 2/2007 Richardson ..... 52/169.1
2007/0175113 A1 * 8/2007 Moule ..... 52/169.5
2007/0214738 A1 * 9/2007 Koessler ..... 52/302.6

* cited by examiner

*Primary Examiner*—Bret Hayes
*Assistant Examiner*—James J Buckle, Jr.
(74) *Attorney, Agent, or Firm*—William Nitkin

(57) ABSTRACT

A device for preventing water seepage over a foundation wall of a building, such device having first and second L-shaped members disposed facing each other with the base of one resting on the base of the other with a conduit resting on the upper base for the receipt and direction of water away from the foundation wall.

3 Claims, 2 Drawing Sheets

CURTAIN DRAIN

BACKGROUND OF THE INVENTION

1. Field of the Invention

The device of this invention resides in the area of structures for directing water away from building foundations and more particularly relates to a structure placed against the exterior of a building foundation to direct water pooling on the ground to distant collection areas to prevent such water from passing over the foundation under the wood frame and into the basement of the building.

2. History of the Prior Art

Buildings, such as homes, having foundation walls resting upon footings wherein gravel is placed against the exterior of such foundation up to the ground level are well known. Water pooling on the ground surface often seeps over the foundation and down the wall into the basement, and such seepage is undesirable. A curtain drain is designed to intercept the lateral movement of the surface water and direct the surface water to another location away from the building. Curtain drains are shallower than drainage systems that are sometimes termed perimeter drains, french drains and footer drains.

SUMMARY OF THE INVENTION

It is an object of this invention to provide an improved barrier to water seeping over a basement foundation, under the framing and plywood, and into a basement of a building by directing such water laterally along the exterior of the foundation wall through a conduit where such water can be directed to air on a sloped hill or collected in a bubbler pot, well, pump or the like located away from the foundation to prevent its passage into the basement.

DESCRIPTION OF THE PREFERRED EMBODIMENT(S)

Figure 1:
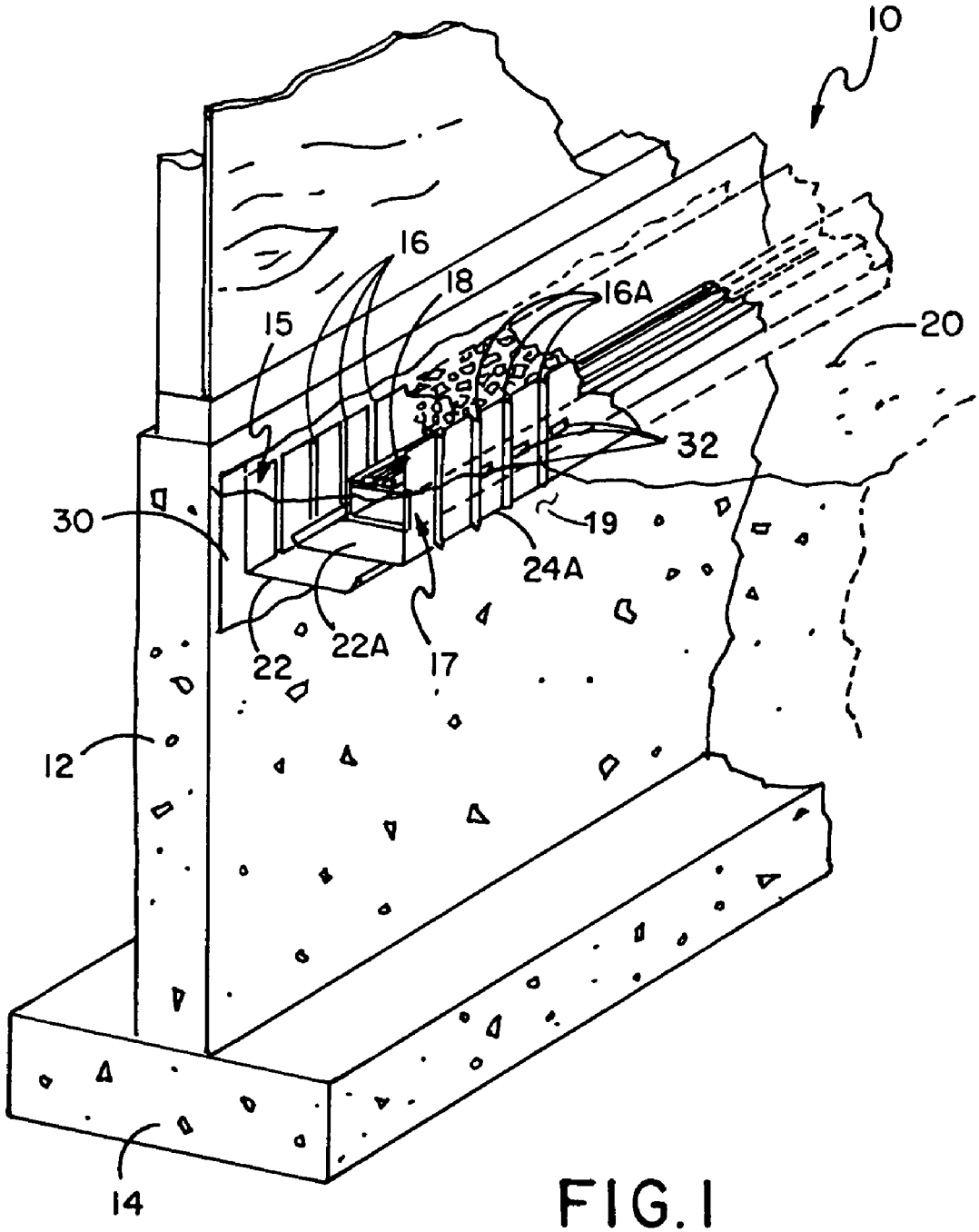
FIG. 1 illustrates a perspective cutaway view of the Curtain Drain of this invention positioned against the exterior of a foundation wall.
Figure 2:
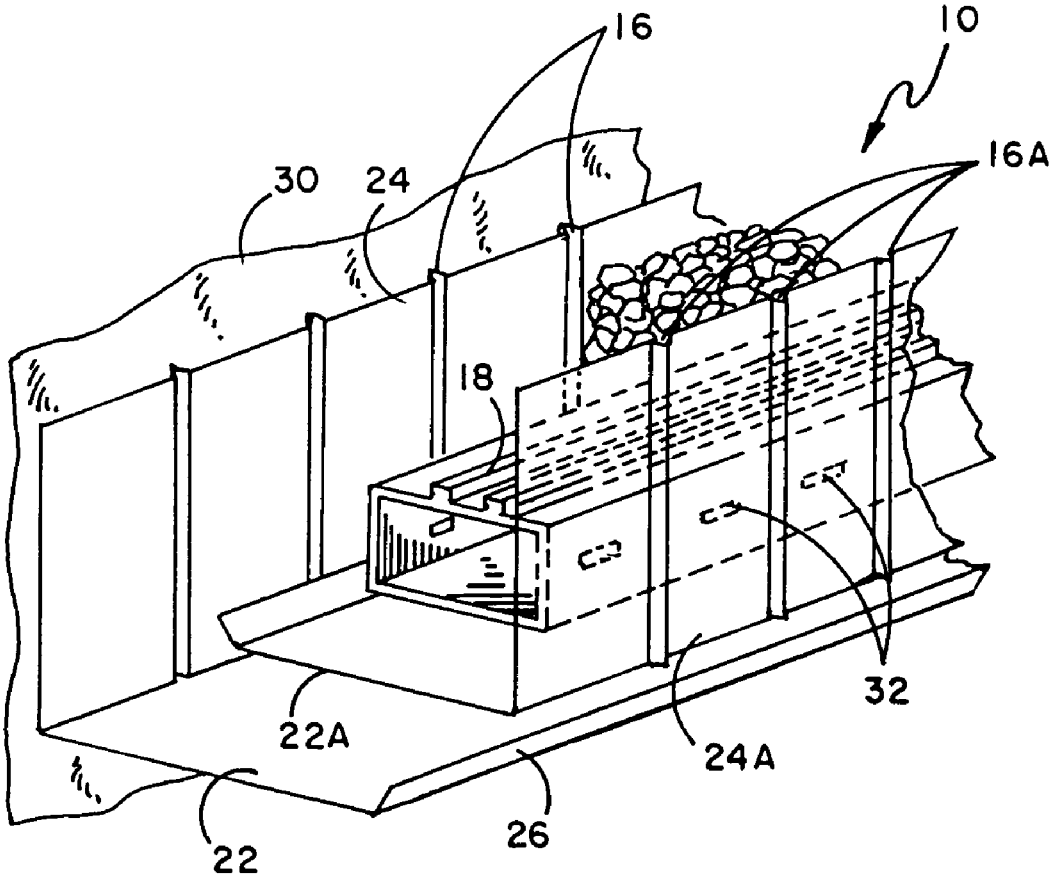
FIG. 2 illustrates an enlarged perspective cutaway view of the Curtain Drain of this invention with the foundation wall not shown.

FIG. 1 illustrates a perspective view of curtain drain 10 of this invention made of two L-shaped members having identical structure disposed facing each other. First L-shaped member has a vertical wall 24 approximately 8 inches high extending from, and attached to, a horizontally extending base 22 of approximately 5 inches in length having a lip 26 positioned at its end opposite the wall, such lip 26 being approximately ±½ inch in length and extending upwards at an angle of approximately 45 degrees. A plurality of spaced apart reinforcements are disposed in parallel vertical alignment along vertical wall 24 which in one embodiment can each be formed in a V-shape, forming V-shaped reinforcements 16 to give vertical wall 24 greater strength. Device 10 is positioned so that the bottom of base 22 of first L-shaped member 15 rests upon dirt/gravel 20 and vertical wall 24 is positioned in contact with the exterior 19 of foundation wall 12 positioned on footing 14. Plastic sheet 30 is positioned against the exterior 19 of foundation wall 12 extending from a level above the top of grass on dirt 20 down along the surface of exterior 19 of foundation wall 12 so as to extend below base 22 of vertical wall 24 of first L-shaped member 15. Second L-shaped member 17 has the same structure as first L-shaped member 15 but is reversed in position so that its base **22*a* rests upon base 22 and its vertical wall 24*a* extends upwards parallel to vertical wall 24. Vertical wall 24*a* has the same V-shaped reinforcements 16*a* as V-shaped reinforcements 16 of first L-shaped member 15. Conduit 18 is then positioned on the top of base 22*a* and extends the length of the device, such conduit having a plurality of apertures 32 defined in its vertical sides. Dirt/gravel 20 fills the area defined between vertical walls 24 and 24*a* above base 22*a***.

During use of the device of this invention, water seeping through dirt/gravel 20 is blocked by vertical walls 24 and **24*a* from contacting the exterior 19 of foundation wall 12. If such water should pass over wall 24*a*, then it would seep down through dirt/gravel 20 to apertures 32 within conduit 18 and be drained within conduit 18 to a water disposal or collection area, such as a bubbler pot, not illustrated but well known in the art, which is installed away from the foundation wall. Such water flow through conduit 18 reduces the amount of water that might flow against plastic sheet 30 and reduces seepage that might pass into, through, or over foundation wall 12**.

Although the present invention has been described with reference to particular embodiments, it will be apparent to those skilled in the art that variations and modifications can be substituted therefor without departing from the principles and spirit of the invention.

I claim:

1. A device for preventing water seepage over a foundation wall of a building, said foundation wall having an exterior and a top against which gravel is filled to ground level, comprising:

a first L-shaped member having an elongated base having a first end, a second end, a top and a bottom, said elongated base disposed horizontally;

an outer wall extending vertically from said first end of said base, said outer wall being approximately 8 inches in height and positioned against the exterior of the top of said foundation wall;

an elongated lip member having first and second ends, said second end attached to, and extending from, said second end of said base, said lip member disposed upwards at approximately a 45 degree angle to said base; and a second L-shaped member having:

an elongated base having a first end, a second end, a top and a bottom, said elongated base disposed horizontally and resting on said base of said first L-shaped member;

an outer wall extending vertically from said first end of said base of said second L-shaped member, said outer wall being approximately 6 inches in height; and an elongated lip member having first and second ends, said second end attached to, and extending from, said second end of said base of said second L-shaped member, said lip member of said second L-shaped member disposed upwards at approximately a 45 degree angle to said base of said second L-shaped member, said second L-shaped member being reversed in position.

2. The device of claim 1 further including a plurality of vertically disposed and spaced apart elongated V-shaped reinforcements defined in said outer walls of said first and second L-shaped members for adding strength thereto.

3. The device of claim 2 further including:

a sheet of plastic disposed against said foundation wall, said sheet of plastic extending downward from above ground level to below said base of said first L-shaped member; and a conduit having a length and a plurality of apertures defined therein, said conduit extending along said top of said base of said second L-shaped member between said lip and said outer wall thereof, said apertures in said conduit for collecting water passing through said gravel positioned over said device, against said plastic sheet and above said conduit, said conduit for drainage of the collected water to a water collection point along said length of said conduit.

* * * * *